US012304610B2

(12) United States Patent
Pajank

(10) Patent No.: US 12,304,610 B2
(45) Date of Patent: May 20, 2025

(54) WING RIG

(71) Applicant: Boards & More GmbH, Oberhaching (DE)

(72) Inventor: Max Pajank, Gols (AU)

(73) Assignee: Boards & More GmbH, Oberhaching (DE)

( * ) Notice: Subject to any disclaimer, the term of this patent is extended or adjusted under 35 U.S.C. 154(b) by 335 days.

(21) Appl. No.: 18/040,645

(22) PCT Filed: Aug. 10, 2021

(86) PCT No.: PCT/EP2021/072295
§ 371 (c)(1),
(2) Date: Feb. 5, 2023

(87) PCT Pub. No.: WO2022/038000
PCT Pub. Date: Feb. 24, 2022

(65) Prior Publication Data

US 2023/0294807 A1 Sep. 21, 2023

(30) Foreign Application Priority Data

| | | |
|---|---|---|
| Aug. 17, 2020 | (DE) | 10 2020 121 553.3 |
| Mar. 22, 2021 | (DE) | 10 2021 106 993.9 |
| Mar. 29, 2021 | (DE) | 20 2021 101 663.9 |

(51) Int. Cl.

| | |
|---|---|
| ***B63H 8/18*** | (2020.01) |
| ***B63H 8/12*** | (2020.01) |
| ***B63H 8/21*** | (2020.01) |

(52) U.S. Cl.
CPC ..... *B63H 8/18* (2020.02); *B63H 8/12* (2020.02); *B63H 8/21* (2020.02)

(58) Field of Classification Search
CPC ... B63H 8/18; B63H 8/12; B63H 8/21; B63H 8/16
See application file for complete search history.

(56) References Cited

U.S. PATENT DOCUMENTS

| | | | | |
|---|---|---|---|---|
| 4,563,969 | A | 1/1986 | Le Bail | |
| 4,651,665 | A | 3/1987 | Drake | |
| 5,448,961 | A | 9/1995 | Ansteensen | |
| 7,017,860 | B2 | 3/2006 | Royannais et al. | |
| 2018/0148148 | A1* | 5/2018 | Joa | B63H 9/0615 |

FOREIGN PATENT DOCUMENTS

| | | | | |
|---|---|---|---|---|
| CN | 109178232 | A | * | 1/2019 |
| DE | 3140685 | A1 | | 4/1983 |
| DE | 3215764 | A1 | | 11/1983 |
| DE | 102015117708 | A1 | | 5/2016 |
| DE | 102019101656 | A1 | | 7/2020 |
| DE | 102020122143 | A1 | | 5/2021 |
| DE | 102020122145 | A1 | | 5/2021 |

(Continued)

OTHER PUBLICATIONS

Office Action dated Jul. 26, 2023 in EPO App. Ser. No. 21 759 068.6 with English translation.

(Continued)

*Primary Examiner* — Andrew Polay
(74) *Attorney, Agent, or Firm* — Henricks Slavin LLP

(57) ABSTRACT

Disclosed is a wing rig having detachable handles fastened to a front tube or a center strut.

17 Claims, 7 Drawing Sheets

(56) References Cited

FOREIGN PATENT DOCUMENTS

| | | | |
|---|---|---|---|
| EP | 1512619 | A1 | 3/2005 |
| FR | 2754237 | A1 | 4/1998 |
| WO | WO 80/01786 | A1 | 9/1980 |
| WO | WO 95/05973 | A1 | 3/1995 |

OTHER PUBLICATIONS

International Search Report dated Nov. 30, 2021 for PCT App. Ser. No. PCT/EP2021/072295.

Hocquinghem, Stéphane, "Wing Surf Swing la nouvelle aile de F-One," Foil Magazine, Jun. 24, 2019, Retrieved from internet Nov. 11, 2019, https://foil-magazine.com/wing-surf-decouvrez-une-nouvelle-dimension-du-sup-avec-la-swing-de-f-one/.

Office Action dated Jan. 26, 2023 in EPO App. Ser. No. 21 759 068.6 with English translation.

English translation of Office Action dated Oct. 30, 2023 in DE App. Ser. No. 10 2021 106 993.9.

* cited by examiner

WING RIG

The invention relates to a hand-held wing rig for wind-powered sports such as wing foiling according to the preamble of claim 1.

Such a wing rig, also known as a foil wing or wing foil, is described on the Internet, for example, under the name "Slingwing". In principle, it is a wing designed similar to a kite with a front tube forming a leading edge and a single strut, which are configured to be inflatable. On each of the central strut and the front tube, holding straps with which the user holds the inflatable wing rig during use, for example when foiling or ice surfing or skiing, are formed.

This inflatable wing rig is severely deformed during use, especially at the high speeds achieved when foiling, and the aerodynamics are thus impaired.

A further disadvantage of said known wing rig is that the holding straps are configured to be flexible so that precise guidance of the wing rig, for example during tacking and jibing, where a change of hands is required, is made more difficult. In addition, said holding straps are firmly attached to the leading edge or strut, making them difficult to replace or adjust.

Also known are solutions in which rigid handles are attached to the leading edge or the strut instead of the flexible holding straps. Such wing rigs, however, require considerable storage space when disassembled and deflated due to the protruding handles.

A rigid wing rig is shown in U.S. Pat. No. 4,563,969, wherein the leading edge and a boom are formed by a complex tube construction that spans a canopy. The leading edge is curved in an arc shape as seen in a plan view. The boom is supported by a plurality of struts at the leading edge. These struts are configured such that they provide the leading edge with a concave structure in a front view, i.e. as seen in the direction of attack of the wing rig, wherein the end portions (tips) of the wing rig are disposed upwards from a central apex of the leading edge.

A disadvantage of this solution is that, due to the complex structure of the boom and the leading edge, the total weight of the wing rig is very high so that it can only be used in water sports with the appropriate buoyancy bodies. Another disadvantage is that the assembly and disassembly of the wing rig takes a long time due to the complex tubular structure. This hard tubular structure of the leading edge and the boom also poses a significant risk of injury to the user in a skidding fall.

A similar rigid wing rig is shown in WO 95/05973 A1. In this solution, too, the leading edge and the boom are formed by a complex tubular structure. The construction shows the same disadvantages as the wing rig according to U.S. Pat. No. 4,563,969 discussed above.

The publication DE 31 40 685 A1 describes a rigid wing rig, wherein the leading edge is formed by two V-shaped masts connected to one another via a central boom and support struts. This wing rig also has a considerable weight due to its tubular structure, which makes handling significantly more difficult, especially in water sports.

In document U.S. Pat. No. 5,448,961, a flat wing rig with a closed frame structure is described-such a solution is also unusable in water sports due to the high weight, the time-consuming assembly/disassembly and the risk of injury.

The German patent application DE 10 2015 117 708 A1 discloses a windsurfing rig configured with an inflatable mast and an inflatable cross strut, together spanning a sail. In this windsurfing rig, a mast foot is integrated into the mast, allowing anchoring to a board. Such a concept is not usable as a hand-held wing rig.

DE 10 2019 101 656 A1, which also is also associated with the applicant, discloses a wing rig with an inflatable front tube and a rigid boom, which together span a sail, with the front tube being set in a V-shape in the attack direction. The rigid boom is detachably attached to the front tube. The disadvantage of such a concept is that the weight of the boom, which extends from the front tube to the leading edge of the sail, is relatively large so that the buoyancy of the wing rig in the center region is relatively low in water. The advantage of this solution is that the boom allows the wing rig to be held very variably, depending on the user's preferences. An additional attachment of handles is not required.

In the post-published publication DE 10 2020 122 145 A1, the aforementioned concept is further developed such that a boom of this kind is attached to an inflatable center strut of the wing rig.

In contrast, the invention is based on the object of creating a hand-held wing rig for wind-powered sports that allows easy handling while needing little storage space.

This object is achieved by a wing rig having the features of claim 1.

Advantageous developments of the invention are the subject matter of the dependent claims.

The hand-held wing rig, which is particularly configured for riding foil boards, has an inflatable front tube from which an inflatable center strut extends.

This center strut is held by the user to guide the wing rig and, together with the front tube, spans a canopy (canopy) which forms the sail surface of the wing rig, so to speak. For optimal handling of the wing rig during maneuvers and while sailing, at least one handle attached to the front tube or to the center strut is provided according to the invention. According to the invention, this handle is configured to be detachable so that the wing rig takes up very little storage space when the handles are removed. Furthermore, for example, different handles may be applied, which are selected depending on the user's preferences.

For example, it is possible to selectively attach rigid or flexible handles. The concept makes it possible, for example, to provide a rigid handle in the center of the front tube while the handles in the area of the center strut are configured to be flexible.

In an exemplary embodiment of the invention, the at least one handle is approximately U-shaped, with the end portions being attached to the front tube or to the center strut by means of suitable adapters.

These adapters may be screw adapters, for example. In principle, however, other force-fit or form-fit adapters, for example with locking bolts or adapters configured for clamping, or mixed forms, may also be used.

In a preferred exemplary embodiment of the invention, the adapter is configured with an adapter console that is attached to the wing rig and has, for example, a threaded bushing to which a support plate of the handle can be attached by means of a screw. The adapter console (patch) may be made of a flexible material, such as TPU.

The support of the handle is optimal when the adapter console is curved in accordance with the diameter of the front tube or the center strut so that the support plate is supported in a flat manner on the outer skin of these elements. The adapter console may be configured as a flexible patch.

In an exemplary embodiment of the invention, the adapter may be configured such that it can be clamped to an end portion of the handle. Such a variant makes it possible to first insert the handle into the adapter without biasing and then to clamp it using suitable measures.

This clamping may be carried out, for example, by inflating the front tube and/or the center strut, wherein the handle is first placed on the adapter when the wing rig is not inflated and then inflating creates a force/form fit and thus a clamping. Such an exemplary embodiment is characterized by a minimal effort in terms of device technology, since, for example, the adapter may only be configured as a strap (more details will be explained below) into which the end portion of the handle is inserted.

The adapter may advantageously extend over a portion of the front tube and/or the center strut (depending on which of these components the handle is attached to) so that the respective end portion of the handle can be used in the region delimited by the adapter on the one hand and the outer skin of the front tube or the center strut on the other hand, with the end portion preferably being clamped against the adapter after the front tube or the center strut has been inflated so that the end portion of the handle is held in a force- and form-fit.

As indicated above, in an embodiment configured very simply, the adapter may be configured in the form of a loop made of a tape- or belt-like material that is connected to the center strut or the front tube. Of course, instead of a tape-like material, a molded part or the like may also be used.

The configuration of the handles is particularly flexible if they are configured in multiple parts with a web and at least one support arm. It is possible, for example, to use different handle concepts by exchanging the web and/or the support arm.

Here, it is preferred when the aforementioned support plate is arranged on an end portion of the respective support arm.

In an embodiment of the invention, the support plate or a web of the handle that is inserted into or attached to the adapter includes an end portion protruding beyond the adapter so that the user can easily check that the handle is positioned on the adapter in a predetermined manner.

The support of the handle is optimal when the support plate is curved in accordance with the diameter of the front tube or the center strut so that the support plate is supported in a flat manner on the outer skin of said elements.

In an embodiment of the invention, the handle may be clamped, on the one side, via a support arm and, on the other side, via the web to the respective adapter. In an alternative solution, the handle includes two support arms, each clamped to an adapter.

The weight of the handle is particularly low when the web is tubular, with each support arm being configured with a connecting piece that is plunged into or partially encompasses the tube so that a reliable positional fixation is ensured. The support arms and the web may be connected in a force-fitting and/or form-fitting manner. The web may be straight or curved.

In an exemplary embodiment of the invention, two handles are arranged in an approximately V-shaped manner that converge, with the converging area being fastened to the center strut and the respective end portions of the handles being fastened to the front tube. These two handles arranged in a V-shape make it easier to perform the maneuvers described above or to hold the wing rig while foiling.

For clarification, it should be noted that the term "adapter" may be understood to mean any device/apparatus suitable for attaching a handle to the wing rig.

Preferred exemplary embodiments of the wing rig according to the invention are explained in more detail below using schematic drawings. In the drawings.

Figure 1:
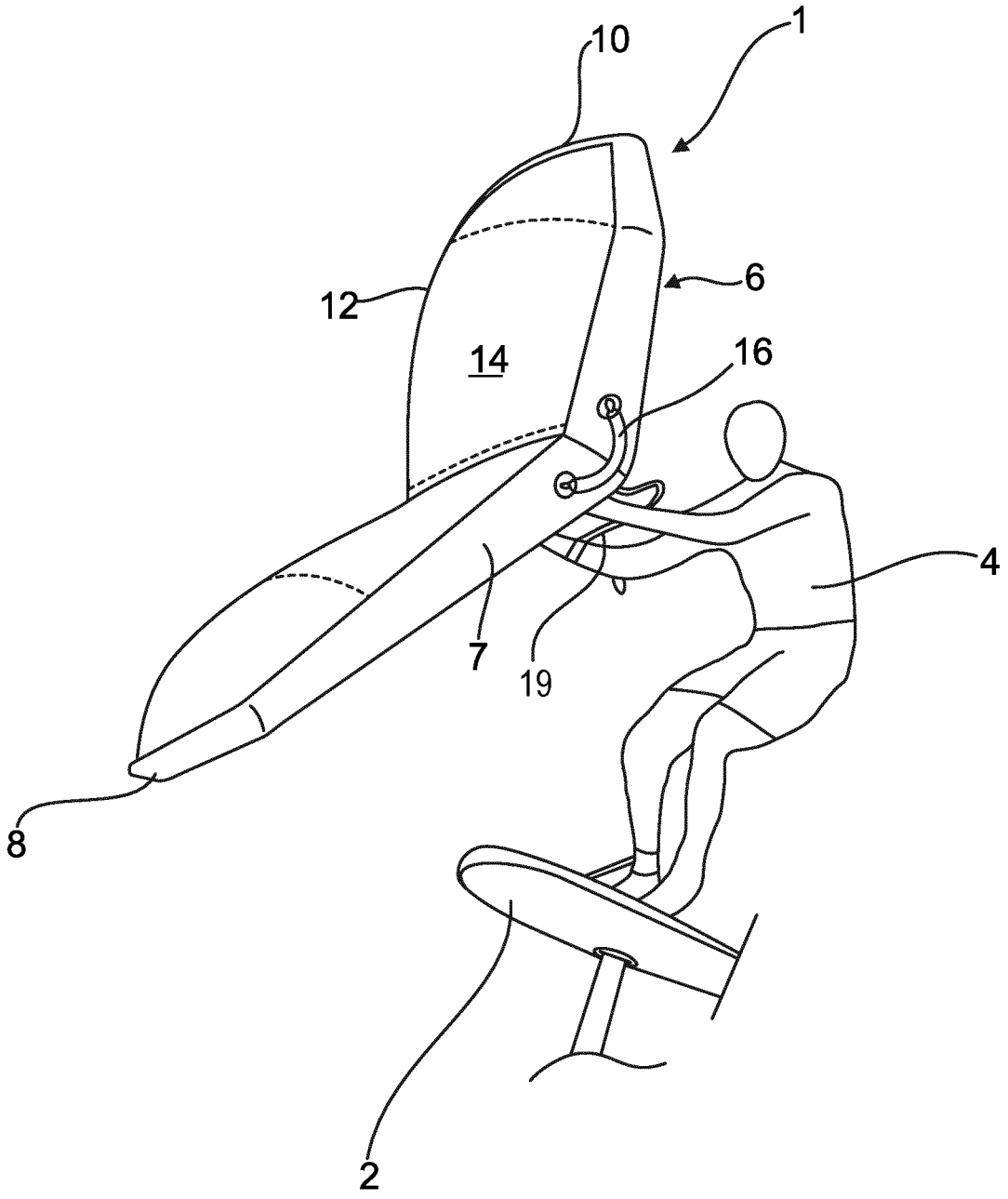
FIG. 1 shows a schematic diagram of a wing rig used to drive a foil board.

FIG. 1 shows the use of a wing rig 1 according to the invention for driving a foil board 2. A surfer 4 holds the wing rig 1 with his/her hands only and adjusts it with respect to the wind depending on the desired direction of travel (close-hauled, beam reach, running downwind) or on the lift to be set, for example when jumping or adjusting the ride height.

The wing rig 1 includes an inflatable front tube 6 with an attack-side leading edge 7 which is approximately arcuate in plan view (from above in FIGS. 1 and 2), preferably approximately delta-, C- or U-shaped and with tips 8, 10 thereof extending to a trailing edge 12 of a canopy 14 of the wing rig 1. As explained below, this canopy 14 is spanned, on the one hand, by the front tube 6 and, on the other hand, by a boom or a center strut (see FIG. 2). The surfer 4 holds the wing rig 1 mainly on the boom/center strut that protrudes downwards (view according to FIG. 1). The front tube 6 is preferably set in a V- or U-shape, both in the top view and in a front view—as seen in the direction of attack, with the V/U in the front view pointing upwards, that is, broadening away from the surfer. As can be seen from FIG. 1, the trailing edge 12 and thus the entire canopy surface 14 is set in a V- (or U-) shape when viewed from the front.

By way of example, a handle arranged centrally in the area of the front tube 6 is identified by the reference symbol 16. This handle 16 is gripped, for example, when the wing rig 1 is held in the wind while driving on a wave without propulsion. This handle 16 is also used when handling the wing rig 1 on land or when starting or ending a trip (water landing).

As explained below, further handles may be positioned on the wing rig 1. A special feature of the handle 16 is that it can be exchanged at the wing rig 1, for example at the front tube 6 or the center strut 18 here.

The illustration according to FIG. 1 also shows a safety leash 17, which is fixed to the wrist of the surfer 4 and the other end portion of which engages the front tube 6

Figure 2:
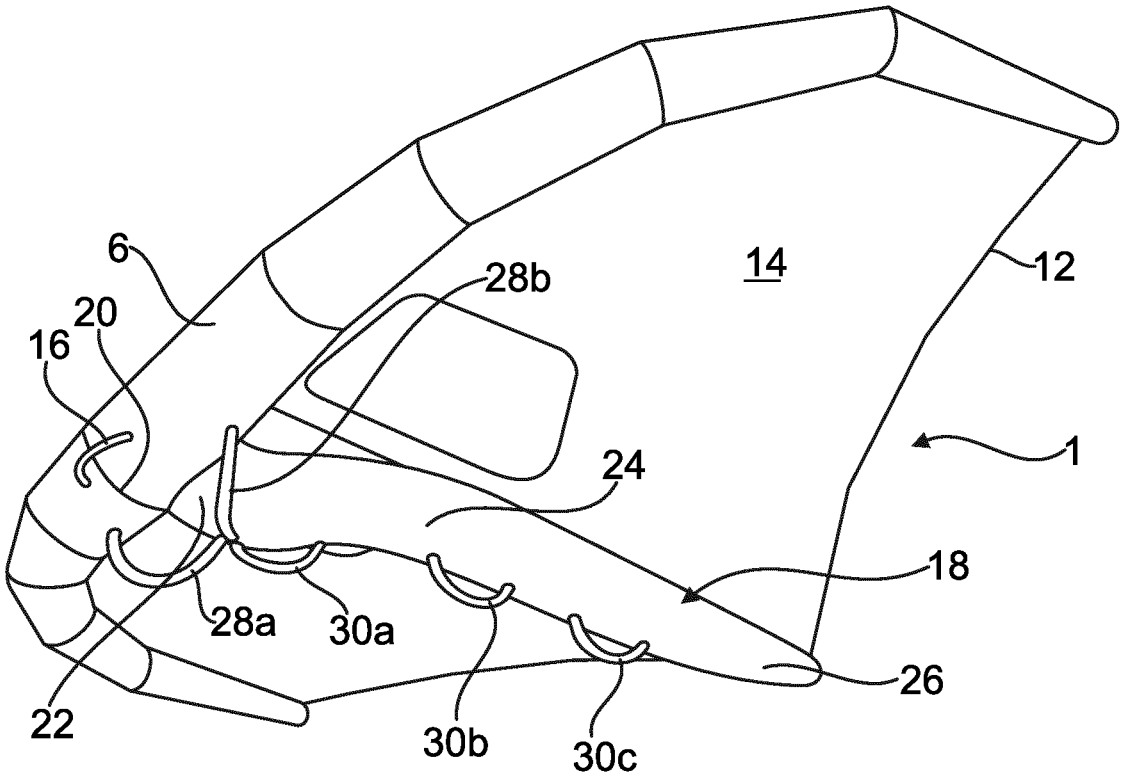
FIG. 2 shows a three-dimensional representation of a wing rig, in which the positions of exchangeable handles having a U-profile are shown by way of example.

FIG. 2 shows a three-dimensional view from below of a wing rig 1 according to FIG. 1. The boom mentioned above, configured as an inflatable center strut 18 in this exemplary embodiment, can be seen in this illustration. The center strut 18 is attached to the front tube 6. The front tube 6 is configured similar to a front tube of a kite and is connected to the inflatable center strut 18 via a one-pump system (not shown in detail) so that both can be filled with air via a common valve. In the illustration according to FIG. 13, the above-described handle 16 is shown bridging an apex 20 of the front tube 6 in the attack direction.

In the exemplary embodiment shown, the center strut 18 is curved upwards, with an attack-side strut portion 22 connected to the front tube 6 being connected to the front tube 6 in the area of the apex 20. Following this strut portion 22 positioned approximately at right angles to the front tube 6, the center strut 18 is curved upwards in a central portion 24 towards the canopy 14 and then transitions into a tapered end portion 26 extending to the trailing edge 12. The canopy 14 is connected to the center strut 18 at least in sections, so that the profile described at the outset is established. The center portion 24 and the downstream end portion 26 are connected to the canopy 14. Between the front strut portion 22 and the canopy 14 there is a space 27 which remains empty or is filled with a cloth wall. The applicant reserves the right to aim an independent claim at the bulging inflatable center strut 28.

In the illustrated embodiment, two V-shaped handles 28*a*, 28*b* are arranged in the region of the strut portion 22, said handles being attached to the strut portion 22 with their converging end portions. The distant end portions of the handles 28*a*, 28*b* are each fastened to the lower side (view according to FIG. 2) of the front tube 6.

FIG. 2 shows three further handles 30*a*, 30*b*, 30*c* according to the invention which are distributed along the center strut 18 from the connection of the two aforementioned handles 28*a*, 28*b* towards the tapered end portion 26 of the center strut 18. These handles are also arranged pointing downwards towards the driver (view according to FIG. 2).

Of course, such handles may also be attached to other positions of the wing rig 1. A special feature is that these handles are held on the center strut 18 of the wing rig 1 such that they can be exchanged in a simple manner. Replaceable is understood to mean a positional fixation that can be released or locked with little effort and with a simple tool, for example a screwdriver or wrench. It is not necessary to unpick seams or loosen rivets or an adhesive layer or the like.

In this way it is possible, for example, to provide different handles at different positions of the wing rig 1, wherein this positioning can be varied according to the preferences of the user. It only has to be ensured that there are appropriate receptacles for fixing the handles 30 in position on the wing rig side.

The handles 30 may be rigid or flexible. In the exemplary embodiment shown, the handles 30 are rounded, for example in a U-shape or V-shape.

Figure 3:
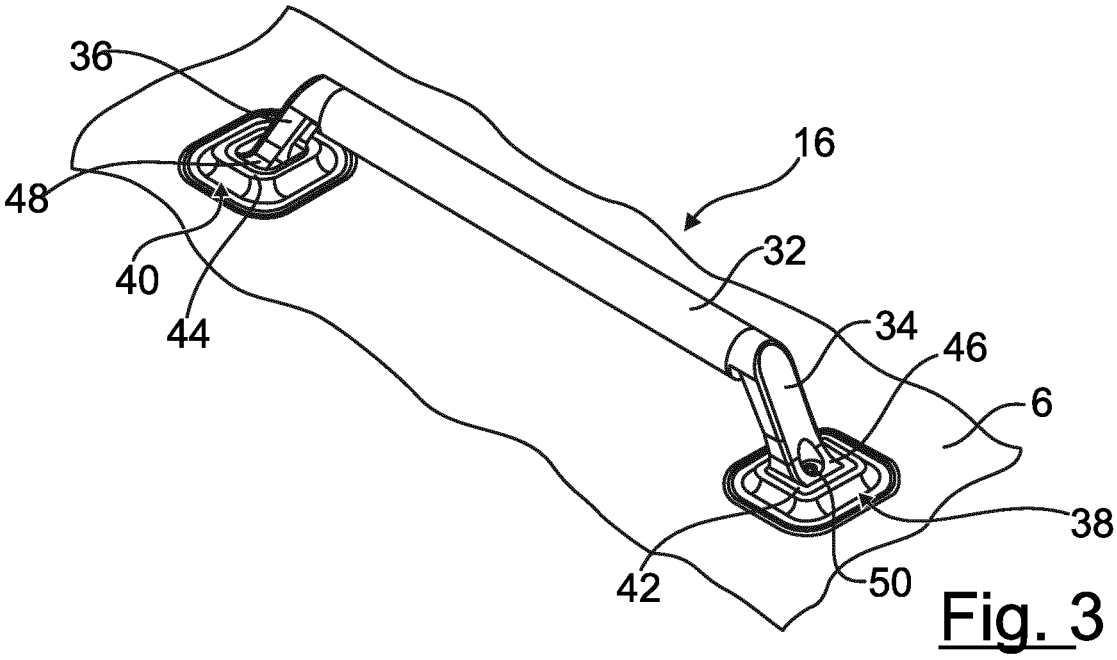
FIG. 3 shows a further exemplary embodiment of a handle which can be fastened at the positions according to FIG. 2 and which is configured as a straight web.

FIG. 3 shows a variant of a handle 16 (of course, the other mentioned handles 28, 30 may also be configured according to FIG. 3), wherein an approximately V-shaped structure with a straight web 32 which is connected to the wing rig 1, for example the front tube 6 (only indicated in FIG. 3), by two support arms 34, 36 positioned at an angle thereto.

Two preferably flexible adapter consoles 38, 40 are arranged on the wing rig side, on each of which a receptacle 42, 44 is formed, into which a threaded bushing, which will be explained below, is inserted. A support plate or a support element 46, 48 of the support arms 34, 36 may be inserted into this receptacle 42, 44 in a form-fitting manner and then fixed in position by means of a fastening screw 50 which is screwed into the threaded bushing of the adapter console 38.

In the illustrated embodiment, the adapter console 38 is sewn and/or glued to the outer skin of the front tube 6 so that the handle 16 is attached to the wing rig 1 in a very rigid manner when the front tube 6 is inflated. The adapter console 38, 40 may be configured to be flexible, for example as a TPU patch.

Figure 4:
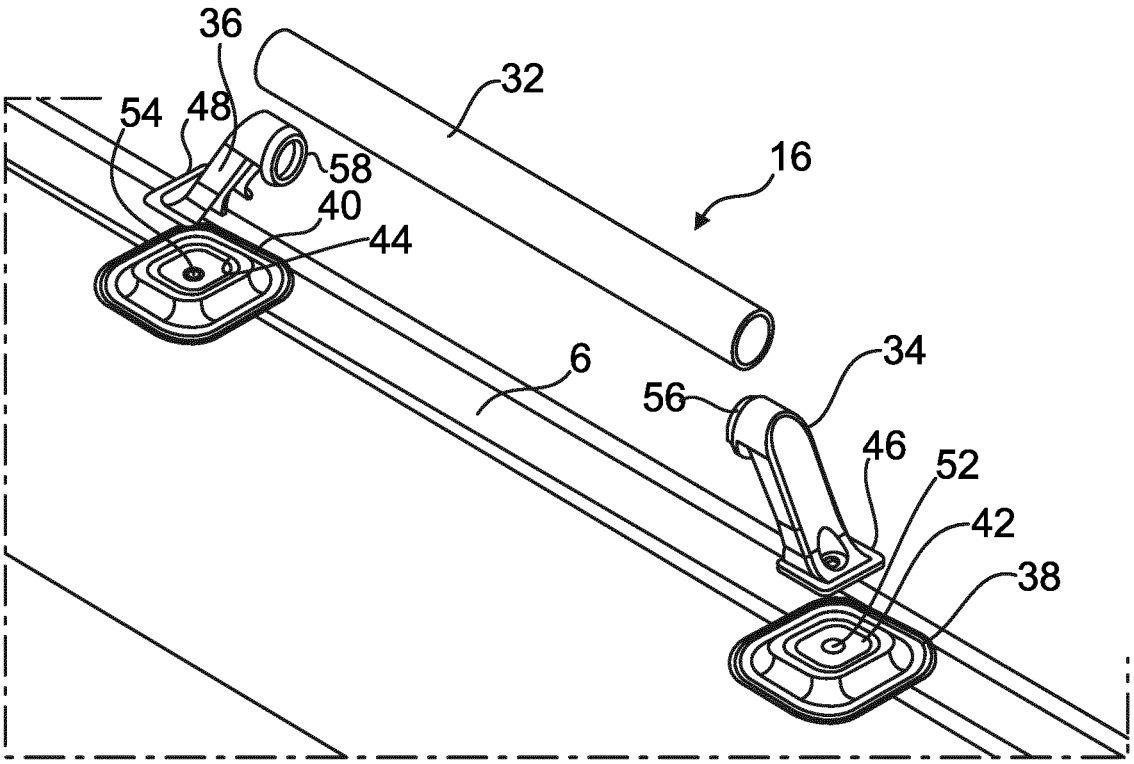
FIG. 4 shows an exploded view of the handle according to FIG. 3.

FIG. 4 shows an exploded view of the handle 16 according to FIG. 3. As explained, said handle 16 is attached to the front tube 6/leading edge 7, the two adapter consoles 38, 40 with the receptacles 42, 44 being attached to the front tube 6. According to the illustration in FIG. 4, said receptacles 42, 44 are each configured as rectangular pockets into which the above-described threaded bushings 52, 54 are centrally inserted. The support plates 46, 48 of the support arms 34, 36 are formed according to the profile of the pocket-shaped receptacles 42, 44 so that they are inserted into them with a precise fit. As explained, the support arms 34, 36 are set at an angle in the exemplary embodiment shown so that they converge towards the web 32. At the end portions pointing towards the web 32, the support arms 34, 36 are formed with connecting pieces 56, 58 aligned coaxially with the web 32 and at least partially enter into the tube profile of the web 32 or encompass the corresponding end portions. The position of the web 32 in relation to the connecting pieces 56, 58 may be fixed, for example, by material bonding, form-fit and/or force-fit.

The illustrated handle 16 may, for example, be made of fiber-reinforced plastic or light metal or another suitable material and is therefore configured to be comparatively rigid. Due to the replaceability, it can be easily exchanged for a flexible handle.

Figure 5:
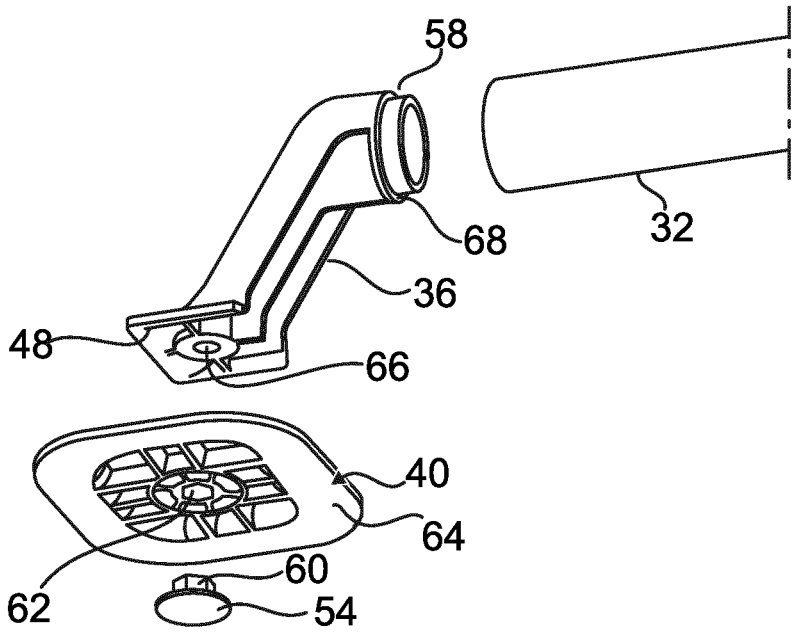
FIG. 5 shows a further partial exploded view of the handle according to FIG. 4.

FIG. 5 shows the adapter bracket 40 (patch), the support arm 36 and part of the web 32 with the threaded bushing 54 in an exploded view. It can be seen from this illustration that, in this exemplary embodiment, the receptacles 42, 44 and the support arms 34, 36 are made of fiber-reinforced plastic, with the wall thicknesses being reduced in order to minimize the weight.

The threaded bushing 54 is inserted into a bushing receptacle 62 with a hexagonal bolt 60 so that the threaded bushing 54 is secured against rotation. The preferably flexible adapter console 40 rests with its contact surface 64 on the outer skin of the front tube 6 or the center strut 18 and is—as explained—for example glued and/or sewn thereto. The inclined support arm 36 includes the support plate 48 described above, which can be inserted into the receptacle 44 of the adapter plate 40 with a precise fit. In the illustrated exemplary embodiment, the support plate 48 is formed with a central bore 66 through which the fastening screw 50 is threadedly engaged with the threaded bushing 54. The connecting piece 58 dips into the inner diameter of the tubular web 32 and has a contact shoulder 68 against which the end face of the web 32 rests flush in the assembled state so that a high-strength connection between the central web 32 and the two outer support arms 34, 36 is ensured.

In principle, however, the handles 16, 28, 30 may also be formed integrally or with a different geometry.

As explained above, instead of the rigid handles 16, 28, 30, flexible handles or mixed types of handles may also be positioned.

In an exemplary embodiment of the invention, a large number of adapter consoles 38, 40 may be provided along the front tube 6 and/or the center strut 18 so that the handles can be positioned individually.

Figure 6:
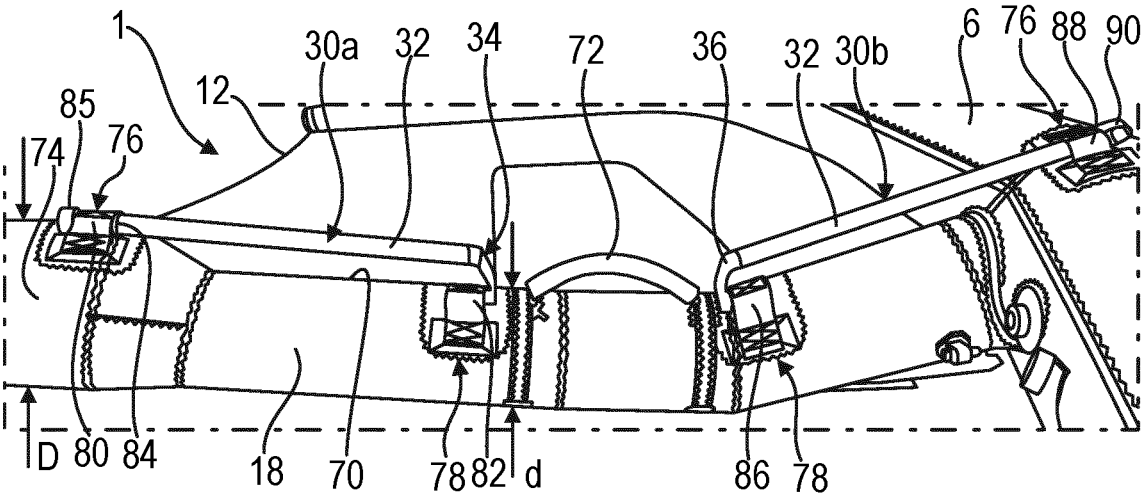
FIG. 6 shows a partial view of a further exemplary embodiment of a wing rig according to the invention with a recessed grip.

FIG. 6 shows another exemplary embodiment of a wing rig 1 according to the invention, wherein the center strut 18 is reduced in diameter d in the area adjacent to the front tube 6 compared to a portion with the diameter D adjacent to the trailing edge 12 so that this recessed step creates a recessed grip 70 in the area of which two handles 30*a*, 30*b* according to the invention and a conventional holding strap 72 disposed between them are arranged. Accordingly, the handles 30*a*, 30*b* extend approximately as an extension of the area of the center strut 18 formed with the diameter D. A special feature of the handles 30*a*, 30*b* is that they are clamped to the center strut 18 or the front tube 6, with this clamping being caused by the wing rig 1 being inflated. After deflation, the handles can be attached to the front tube 6 or the center strut 18 without any tools and without significant effort so that the handles 30*a*, 30*b* can be mounted and removed in an extremely simple manner.

On the one side, the handle 30*a* is fastened to the region 74 with a larger diameter D with the end portion on the left in FIG. 6 and, on the other side, approximately centrally within the recessed grip 70. For attachment, adapters 76, 78 are formed on the center strut 18 via which the handle 30*a* is fixed in position. Specifically, in the illustrated embodiment, the two adapters 76, 78 are each formed by webbing straps 80, 82, which are sewn with their respective end portions to the outer skin of the center strut 18 and which bulge like a bridge so that a reach-through area for a handle portion is formed. In the embodiment shown in FIG. 6, the handle 30*a* includes a support arm 34 on the right end portion, the basic structure of which corresponds approximately to that of the embodiment according to FIGS. 3 to 5 and which is explained in more detail below with reference to FIGS. 9 and 10.

As with the embodiments described above, the support arm 34 is connected to a tubular web 32 which extends to the region 74 including the adapter 76. Here, the tubular end portion 84 of the web 32 enters the strap 80 and passes through it, with the end portion 84 protruding from the strap 80 being fixed in position via a cap 85, into which the end portion 84 dips, so that its movement is restricted to the left in the view according to FIG. 6. As will be explained in more detail below, the support arm 34 enters the strap 82 from the right in the view according to FIG. 6 so that the handle 30*a* is mounted simply by pushing it into the strap 80 or the strap 82 from the right.

The further handle 30*b* is fixed in a corresponding manner via a support arm 36 and via a webbing strap 86 on the center strut 18 and with the end portion of the web 32 on the right in FIG. 6 and another webbing strap 88 on the front tube 6. As in the case of the handle 30*a*, an axial displacement beyond the front tube 6 is prevented by a cap 90 which is attached to the strap 88. The difference in diameter between the front tube 6 and the center strut 18 in the connection region of the handle 30*b* is so large that there is sufficient clear width for gripping the web 32. The handle 30*b* is attached by pushing it into the adapters 76, 78 in the direction of the front tube 6.

Figure 7:
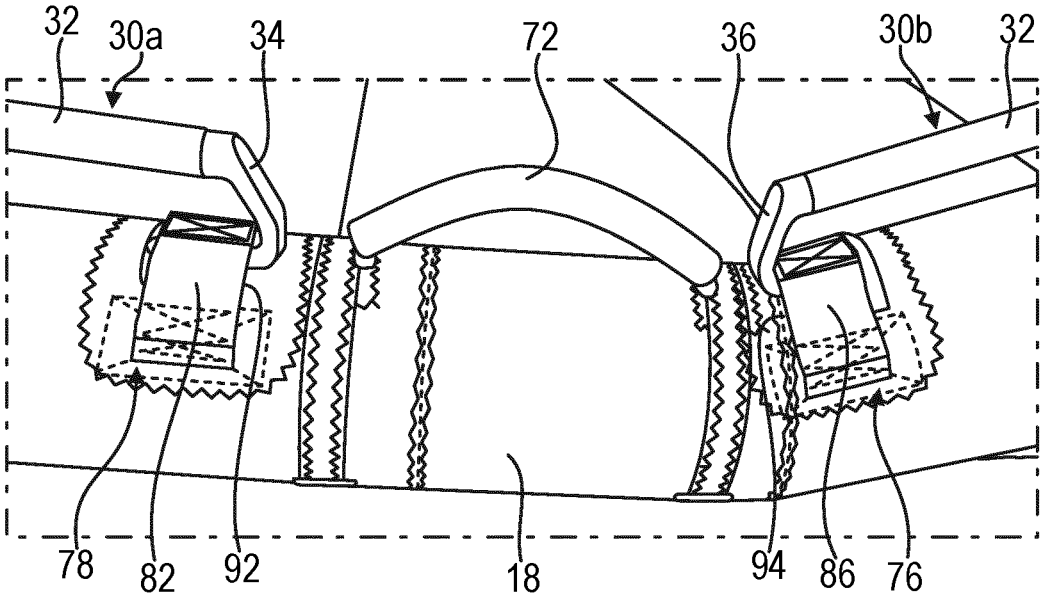
FIG. 7 shows a detailed view of the wing rig according to FIG. 6.

The conventional holding strap 72 is non-detachably mounted between the two support arms 34, 36 and enables the wing rig 1 to be handled even when the handles 30*a*, 30*b* have been removed. This area is shown enlarged in FIG. 7. This depiction clearly shows the two webbing straps 82, 86, the end portions of which are each sewn to the outer skin of the center strut 18 and which bulge in an arc to form a receiving space 92 or 94 for part of the respective support arm 34, 36.

Figure 9:
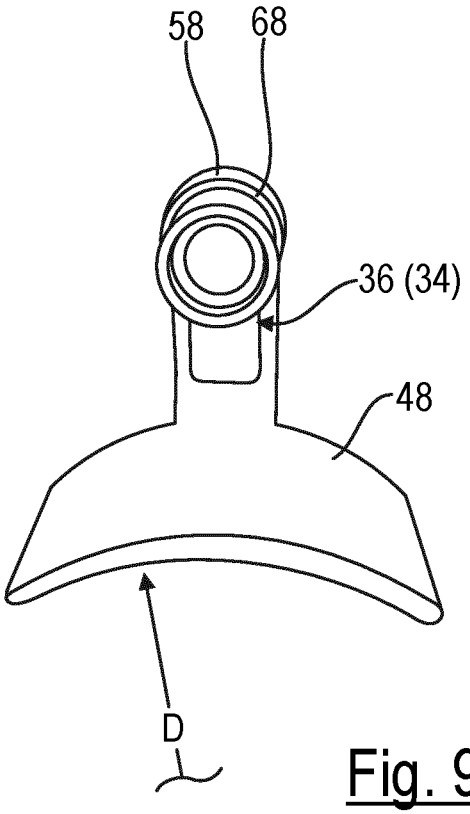
FIG. 9, 10 are views of a support arm of the handle according to FIGS. 6 to 8.
Figure 10:
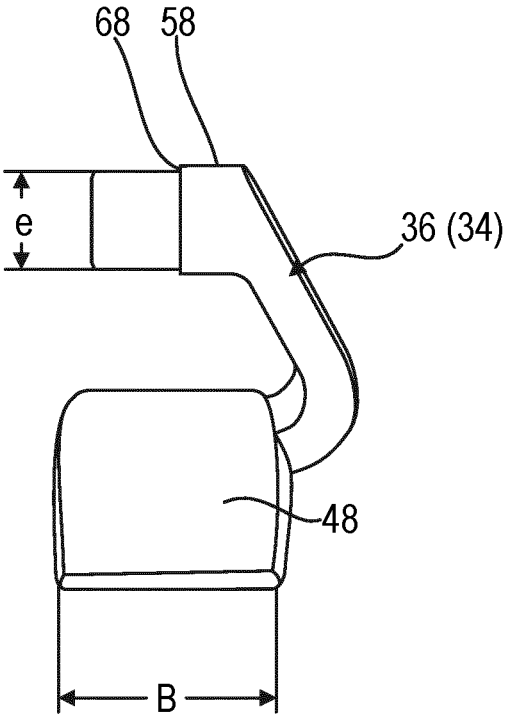

The structure of the support arms 34, 36 is explained, by way of example, with reference to FIGS. 9 and 10 which show an individual representation of the support arm 34. Accordingly, they each have a support plate 48, which is curved according to the diameter D of the center strut 18 or the diameter of the front tube 6, so that a flat contact with these components is ensured. In the illustration according to FIG. 9, the diameter D of the region 74 of the center strut 18 is shown as an example. A support arm 36 is attached to the side of the support plate 48, which in the exemplary embodiment shown is approximately U-shaped with an inclined base, so that the connecting piece 58 formed at the end portion of the support arm 36 runs approximately in parallel to the apex of the support plate 48. As in the exemplary embodiments described above, the connecting piece 58 is recessed by a step so that, in the transition region to the portion with a smaller cross section, a radial contact shoulder 68 is formed. The diameter e of the recessed region then corresponds to the inner diameter of the attached web 32, which rests with its end face on the contact shoulder 68 of the connecting piece 58 in the assembled state. In the illustrated embodiment, the support arm 36 is made of fiber-reinforced plastic. In principle, the support arm 36 may also be made from a different material or by a generative method (3D printing).

Figure 8:
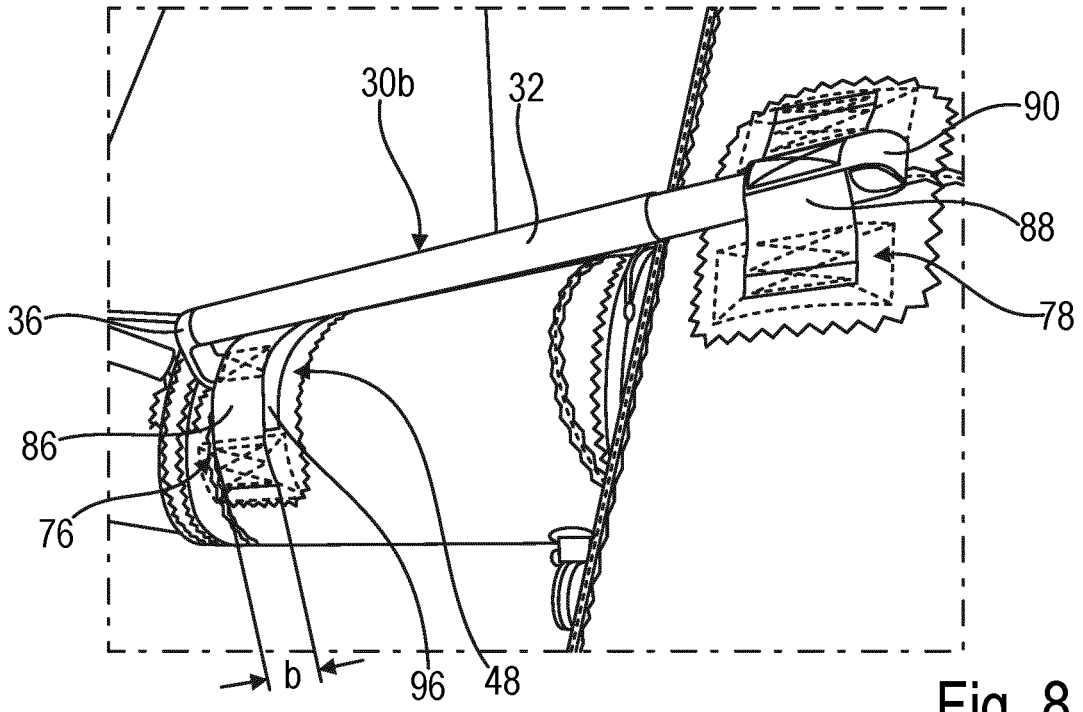
FIG. 8 shows a further detailed view of a handle according to FIG. 7 which is fastened to a center strut on the one side and to the front tube on the other side.

As can be seen particularly well in FIG. 8, the width b of the webbing strap 86 is slightly smaller than the width B (see FIG. 10) of the support plate 48 so that, in the assembled state, the support plate 48 (and of course the other support plates as well) protrudes from the webbing strap 86 with a protrusion 96. In order to fix the position, this protrusion 96 may be provided with a step which abuts against the associated webbing strap 86 in the pull-out direction and thus makes it even more difficult to inadvertently pull the support plate 48 out of the webbing strap 86.

As with the handle 30*a*, the end portion of the web 32 remote from the webbing strap 86 (see particularly FIG. 8) is inserted into the webbing strap 88 and secured by the cap 90 in the axial direction.

Figure 11:
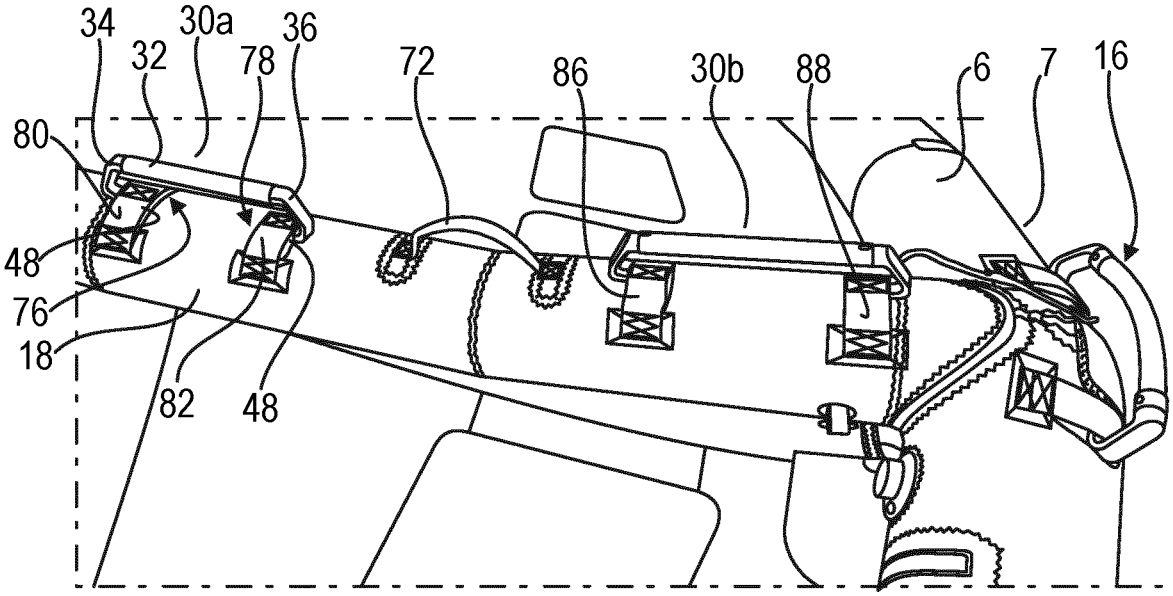
FIG. 11 shows a variant of the exemplary embodiment according to FIG. 6, the handles being fastened only to the center strut and to the front tube, respectively.

FIG. 11 shows an exemplary embodiment in which the two handles 30*a*, 30*b* are only attached to the center strut 18. In this exemplary embodiment, the center strut 18 is not configured with a recessed grip 70 but in a conventional manner so that there is no step in the transition region to the front tube 6 that a handle can overstretch.

In this exemplary embodiment, each of the handles 30*a*, 30*b* is formed with two support arms 34, 36 (only the support arms of the handle 30*a* are provided with reference symbols in FIG. 11) between which the web 32 extends. Accordingly, the two structurally identical support arms 34, 36 are oriented in such a way that their connecting pieces 56, 58 (see FIGS. 9 and 10) point towards one another. The support plates 46, 48 then again engage in the respective webbing straps 80, 82 and 86, 88 in a force-fitting and form-fitting manner. That is, the webs of the handles 30*a*, 30*b* overstretch the respective webbing straps 80, 82 or 86, 88, so that assembly is only possible after deflation, with the handles 30*a*, 30*b* practically not releasable in the inflatable state due to the force/form fit.

Figure 12:
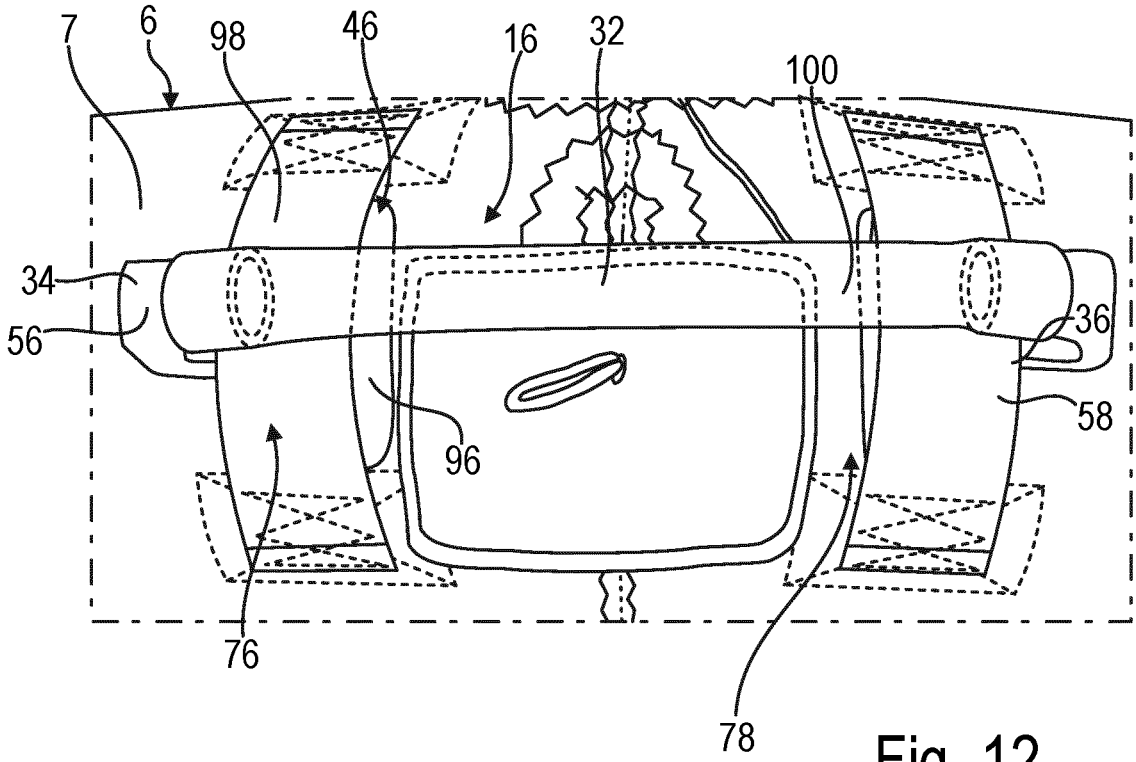
FIGS. 12, 13 show a detailed view of a handle of the embodiment according to FIG. 11.

The conventional holding strap 72 is again mounted between the handles 30*a*, 30*b*. In the exemplary embodiment according to FIG. 11 (and also in the other exemplary embodiments), a handle 16, the structure of which is explained with reference to FIGS. 12 and 13, is detachably fastened to the leading edge 7 of the front tube 6 as an extension of the center strut 18

Accordingly, this handle 16 has again two support arms 34, 36 which are essentially configured in the manner shown in FIGS. 9 and 10. The support plates 46, 48 again dip into webbing straps 98, 100 of the adapters 76, 78 which are fastened to the leading edge 7 of the front tube 6. As in the embodiment described above, the two webbing straps 98, 100 are located between the support arms 34, 36 so that the handle 16 is reliably fixed in position.

Figure 13:
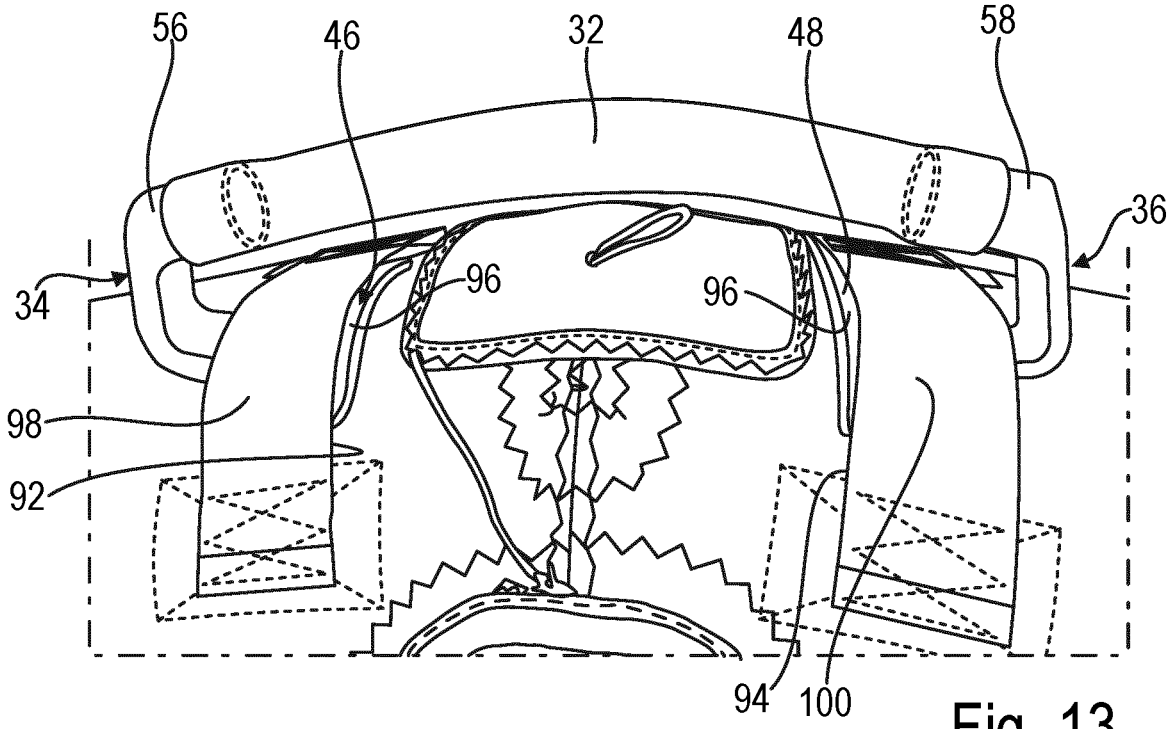

In this exemplary embodiment, a web 32 made of an elastic material, for example a flexible hose, is placed on the two connecting pieces 56, 58 and is curved in accordance with the curvature of the leading edge 7 (see FIG. 13). In the illustrated embodiment, the hose is press fitted onto the recessed end portion of the connecting pieces 56, 58. Of course, the web 32 may also be additionally fixed in position by means of fixing elements, for example catches, screws, clamps or the like. Of course, this also applies to the other handles 28, 30 described.

In the exemplary embodiments described above, the center strut 18 is configured to be inflatable. As explained at the outset, instead of this inflatable center strut 18, a center strut configured as a boom or additionally configured with a boom may also be used. In this case, there is no need to attach handles to the center strut. However, it is definitely advantageous to provide the handles 16 and 28*a*, 28*b* described above in addition to the boom to simplify handling.

A wing rig is disclosed, wherein detachable handles are attached to a front tube or a center strut.

LIST OF REFERENCE SYMBOLS

1 wing rig
2 foil board
4 surfer
6 front tube
7 leading Edge
8 tip
10 tip
12 trailing Edge
14 canopy
16 handle
18 center strut/boom
19 safety leash
20 apex of the front tube/leading edge
22 strut portion
24 center portion
26 end portion
27 distance
28 handle
30 handle
32 web
34 support arm
36 support arm
38 adapter console/patch
40 adapter console/patch
42 receptacle
44 receptacle
46 support plate
48 support plate
50 fastening screw
52 threaded bushing
54 threaded bushing
56 connecting piece
58 connecting piece
60 hexagonal bolt
62 bushing receptacle
64 contact surface
66 bore
68 contact shoulder
70 recessed grip
72 holding strap
74 region of center strut
76 adapter
78 adapter
80 webbing strap
82 webbing strap
84 end portion
85 cap
86 webbing strap
88 webbing strap
90 cap
92 receiving space
94 receiving space
96 protrusion
98 webbing strap
100 webbing strap

The invention claimed is:

1. A foil wing for wind-powered sports, comprising an inflatable front tube (6) from which an inflatable center strut (18) extends which is designed to be held by the user for guiding said foil wing (1), wherein said front tube (6) and said center strut (18) span a canopy (14), and comprising at least one handle (16, 28, 30) fastened to said center strut (18) for holding said foil wing (1), characterized in that said handle (16, 28, 30) is configured to be detachable, said handle (16, 28, 30) being approximately U-shaped or V-shaped or being formed in a plurality of parts with a web (32) and at least one support arm (34, 36) associated therewith, wherein end portions are inserted in adapters (76, 78) attached to said front tube (6) or said center strut (18), said adapters being configured as screw or clamping adapters.

2. The foil wing according to claim 1, wherein said handle (16, 28, 30) is rigid.

3. The foil wing according to claim 2, wherein said adapter (76, 78) has a rig-side adapter console (38, 40) to which a support plate (46, 48) of said handle (16, 28, 30) can be attached, by means of a fastening screw (50).

4. The foil wing according to claim 3, wherein said adapter console (38, 40) is curved corresponding to the diameter (d, D) of said center strut (18) or said front tube (6).

5. The foil wing according to claim 2, wherein said adapter (76, 78) and at least one end portion of said handle (16, 28, 30) are clamped together.

6. The foil wing according to claim 5, wherein said adapter is configured such that, by inflating said front tube (6) and/or said center strut (18), a force/form fitting connection and thus a clamping is generated.

7. The foil wing according to claim 6, wherein said adapter (76, 78) extends over a portion of said front tube (6) or said center strut (18) such that the end portion can be inserted into the receiving space (92, 94) delimited by said adapter (76, 78) on the one hand and by said front tube (6) or said center strut (18) on the other hand, wherein the end portion is clamped together with said adapter (76, 78) after said front tube (6) and/or said center strut (18) has been inflated so that the end portion is held in a force or form fitting manner.

8. The foil wing according to claim 5, wherein said adapter (76, 78) is formed to be loop-shaped from a tape-like or belt-like material connected to said center strut (18) or said front tube (6).

9. The foil wing according to claim 1, wherein said support arm (34, 36) is configured with a support plate (46, 48) at an end portion remote from said web (32).

10. The foil wing according to claim 6, wherein said support arm (34, 36) is configured with a support plate (46, 48) at an end portion remote from said web (32); and said support plate (46, 48) or said web (32) protrudes beyond said adapter (76, 78) with a protrusion (96).

11. The foil wing according to claim 9, wherein said support plate (46, 48) is curved corresponding to the diameter (d, D) of said center strut (18) or said front tube (6).

12. The foil wing according to claim 5, wherein said handle (16, 28, 30) is clamped together with the respective adapter (76, 78) via a support arm (34, 36) on the one side and via said web (32) on the other side.

13. The foil wing according to claim 9, wherein said web (32) is tubular or hose-shaped and said support arm (34, 36) enters into the tubular profile of said web (32) with a connecting piece (56, 58) or encompasses said tubular profile in sections.

14. The foil wing according to claim 13, wherein said web (32) is formed to be straight or curved.

15. The wing rig according to claim 1, wherein two handles (28*a*, 28*b*) are fastened in an approximately V-shaped manner to said center strut (18) on the one side and to said front tube (6) on the other side.

16. The wing rig according to claim 1, wherein at least one, flexible, handle (16) is non-detachably fastened to said front tube (6) and/or to said center strut (18).

17. The foil wing according to claim 1, wherein said handle (16, 28, 30) is flexible.

* * * * *